US011425495B1

(12) United States Patent
Mansour

(10) Patent No.: US 11,425,495 B1
(45) Date of Patent: Aug. 23, 2022

(54) SOUND SOURCE LOCALIZATION USING WAVE DECOMPOSITION

(71) Applicant: Amazon Technologies, Inc., Seattle, WA (US)

(72) Inventor: Mohamed Mansour, Cupertino, CA (US)

(73) Assignee: Amazon Technologies, Seattle, WA (US)

( * ) Notice: Subject to any disclaimer, the term of this patent is extended or adjusted under 35 U.S.C. 154(b) by 0 days.

(21) Appl. No.: 17/234,233

(22) Filed: Apr. 19, 2021

(51) Int. Cl.
*H04R 1/40* (2006.01)

(52) U.S. Cl.
CPC ..... *H04R 1/406* (2013.01); *H04R 2225/55* (2013.01); *H04R 2460/07* (2013.01)

(58) Field of Classification Search
None
See application file for complete search history.

(56) References Cited

U.S. PATENT DOCUMENTS 9,689,960 B1 * 6/2017 Barton ..... G01S 3/805
2015/0373477 A1 * 12/2015 Norris ..... H04M 1/6033 381/303

* cited by examiner

*Primary Examiner* — Kenny H Truong
(74) *Attorney, Agent, or Firm* — Pierce Atwood LLP

(57) ABSTRACT

A system that performs sound source localization (SSL) using acoustic wave decomposition (AWD) or an approximation. When a device detects a wakeword represented in audio data, the device performs SSL processing in order to determine a position of the user relative to the device (e.g., estimate angle of the user). The device calculates noise statistics based on first audio data representing the wakeword and second audio data preceding the wakeword. Thus, upon detecting the wakeword, the device calculates the noise statistics and a signal quality metric corresponding to the wakeword. In addition, the device uses Multi-Channel Linear Prediction Coding (MCLPC) coefficients to average out the room impulse response. Using the noise statistics, the MCLPC coefficients, and the audio data, the device performs AWD processing to decompose the sound field to disjoint acoustic plane waves, enabling the device to identify the most likely direction for the line-of-sight component of speech.

20 Claims, 5 Drawing Sheets

SOUND SOURCE LOCALIZATION USING WAVE DECOMPOSITION

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

DETAILED DESCRIPTION

Electronic devices may be used to capture audio data and generate audio. For example, an electronic device may generate audio using loudspeakers and may capture audio data using one or more microphones. If the electronic device is located in the vicinity of hard surfaces (e.g., walls, ceiling, shelves, etc.), the presence of acoustically reflective surfaces negatively impacts performance of the electronic device. For example, the presence of acoustically reflective surfaces can have a negative effect on both speech recognition performance and sound quality, and reflections from the acoustically reflective surfaces can confuse sound source localization. As a result, the device may be unable to accurately locate a user.

To improve a user experience, devices, systems and methods are disclosed that perform sound source localization (SSL) using acoustic wave decomposition (AWD). When a device detects a wakeword represented in audio data, the device performs SSL processing in order to determine a position of the user relative to the device (e.g., estimate angle of the user). The device calculates noise statistics based on a first audio data that represents the wakeword and second audio data preceding the wakeword. Thus, upon detecting the wakeword, the device calculates the noise statistics and a signal quality metric corresponding to the wakeword. In addition, the device makes use of Multi-Channel Linear Prediction Coding (MCLPC) coefficients to average out the room impulse response. Using the noise statistics, the MCLPC coefficients, and the audio data, the device performs AWD processing (or an approximation of AWD processing) to decompose the sound field to disjoint acoustic plane waves, enabling the device to identify the most likely direction for the line-of-sight component of speech.

Figure 1:
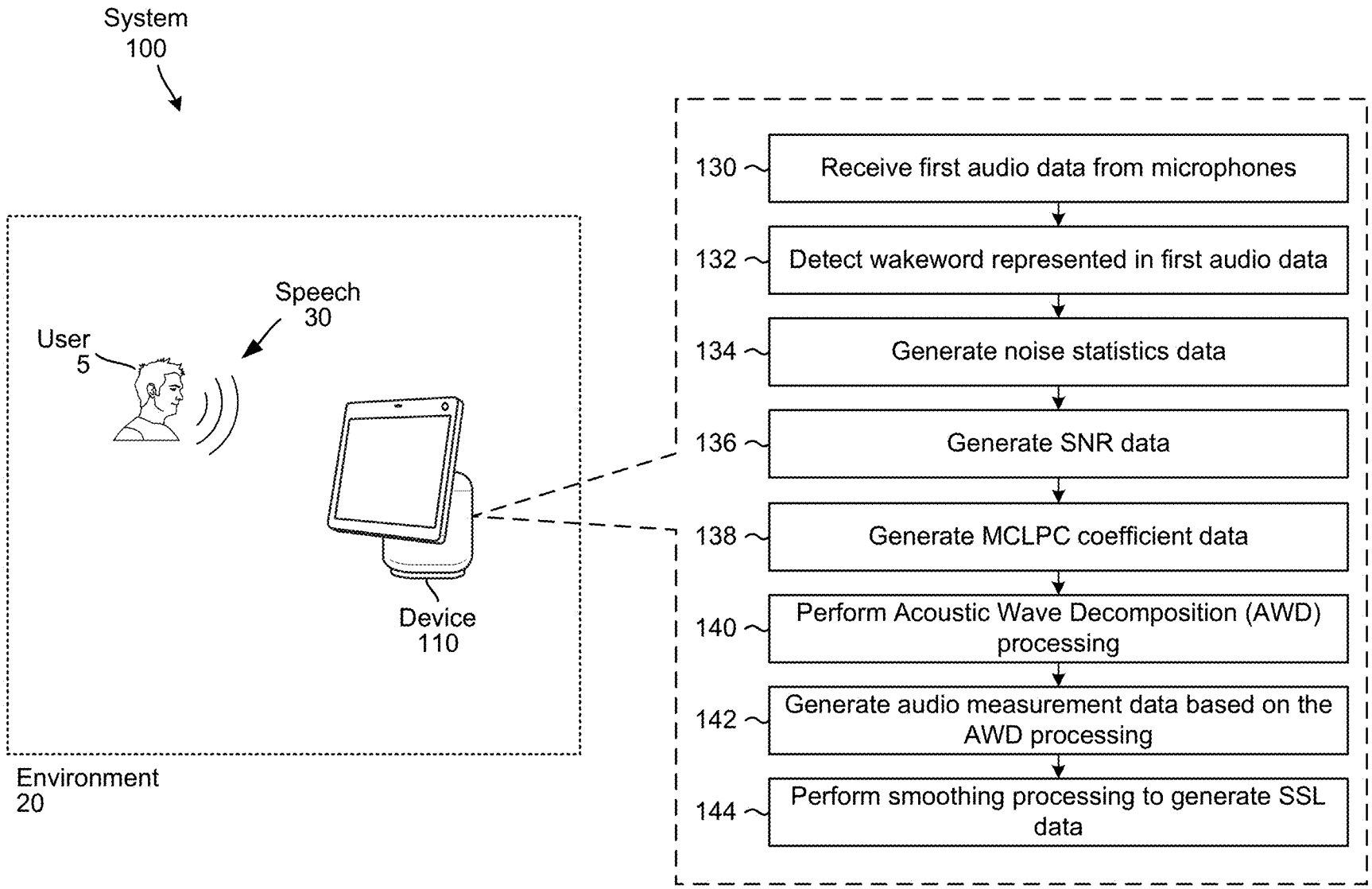
FIG. 1 illustrates a system for performing sound source localization (SSL) using acoustic wave decomposition according to embodiments of the present disclosure.

FIG. 1 illustrates a system for performing sound source localization using acoustic wave decomposition according to embodiments of the present disclosure. As illustrated in FIG. 1, a system 100 may include a device 110 that has one or more microphone(s) 112 and one or more loudspeaker(s) 114. To detect user speech or other audio, the device 110 may use one or more microphone(s) 112 to generate microphone audio data that captures audio in a room (e.g., an environment) in which the device 110 is located. As is known and as used herein, "capturing" an audio signal includes a microphone transducing audio waves (e.g., sound waves) of captured sound to an electrical signal and a codec digitizing the signal to generate the microphone audio data.

The device 110 may optionally send playback audio data to the loudspeaker(s) 114 and the loudspeaker(s) 114 may generate audible sound(s) (e.g., output audio) based on the playback audio data. When the loudspeaker(s) 114 generate the audible sound(s), the microphone(s) 112 may capture portions of the audible sound(s) (e.g., an echo), such that the microphone audio data may include a representation of the audible sound(s) generated by the loudspeaker(s) 114 (e.g., corresponding to portions of the playback audio data) in addition to any additional sounds (e.g., local speech from a user) picked up by the microphone(s) 112.

As illustrated in FIG. 1, a user 5 may generate speech 30 corresponding to a voice command. The device 110 may receive (130) first audio data from microphones and may detect (132) a wakeword represented in the first audio data. In some examples, the microphone(s) 112 may be included in a microphone array, such as an array of four microphones. However, the disclosure is not limited thereto and the device 110 may include any number of microphone(s) 112 without departing from the disclosure.

The device 110 may generate (134) noise statistics data corresponding to a noise floor before the wakeword was detected. For example, the device 110 may determine a first portion of the first audio data associated with the wakeword and a second portion of the first audio data preceding the first portion. The device 110 may determine a microphone energy level associated with the first portion and a noise energy level associated with the second portion, which may both be included in the noise statistics data although the disclosure is not limited thereto. Using the microphone energy level and the noise energy level, the device 110 may generate (136) Signal-to-Noise Ratio (SNR) data. While FIG. 1 illustrates steps 134 and 136 as two separate steps, the disclosure is not limited thereto and in some examples the device 110 may determine noise statistics data that includes the SNR data without departing from the disclosure.

The device 110 may generate (138) Multi-Channel Linear Prediction Coding (MCLPC) coefficient data using any techniques without departing from the disclosure. For example, Linear Prediction Coding (LPC) is a procedure that is used during speech processing. Thus, the device 110 may make use of the MCLPC coefficient data to perform AWD SSL processing.

Using the MCLPC coefficient data, the noise statistics data, and the first audio data, the device 110 may perform (140) Acoustic Wave Decomposition (AWD) processing to generate weight data, as described in greater detail below with regard to FIG. 2. For example, the device 110 may perform AWD processing twice to generate two sets of weight values, a first set using the first audio data and a second set using the MCLPC coefficient data. As described below with regard to FIG. 2, the device 110 may use the first set, the second set, and/or a combination thereof to improve SSL processing based on the SNR data without departing from the disclosure. While FIG. 1 illustrates the device 110 performing AWD processing (e.g., performing full decomposition to generate $\alpha_l$), the disclosure is not limited thereto and the device 110 may approximate AWD processing (e.g., determine a cross-correlation to generate $\rho_l$) without departing from the disclosure.

The device 110 may generate (142) audio measurement data based on the AWD processing. For example, the device 110 may generate a likelihood function and determine local maxima using the likelihood function, as described in greater detail below. The device 110 may then perform (144) smoothing processing to this audio measurement data to generate sound source localization (SSL) data. For example, the device 110 may perform SSL processing to distinguish between multiple sound sources represented in the first audio data, enabling the device 110 to separate a first portion of the first audio data representing the speech 30 from a second portion of the first audio data representing other audible sounds.

While not illustrated in FIG. 1, in some examples the device 110 may process a portion of the SSL data to cause an action to be performed. For example, the device 110 may cause speech processing to be performed on the first portion of the first audio data, which represents the speech 30, in order to determine the voice command uttered by the user 5. The device 110 may then cause an action to be performed that is responsive to the voice command.

An audio signal is a representation of sound and an electronic representation of an audio signal may be referred to as audio data, which may be analog and/or digital without departing from the disclosure. For ease of illustration, the disclosure may refer to either audio data (e.g., reference audio data or playback audio data, microphone audio data or input audio data, etc.) or audio signals (e.g., playback signals, microphone signals, etc.) without departing from the disclosure. Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

In some examples, the audio data may correspond to audio signals in a time-domain. However, the disclosure is not limited thereto and the device 110 may convert these signals to a subband-domain or a frequency-domain prior to performing additional processing, such as adaptive feedback reduction (AFR) processing, acoustic echo cancellation (AEC), noise reduction (NR) processing, and/or the like. For example, the device 110 may convert the time-domain signal to the subband-domain by applying a bandpass filter or other filtering to select a portion of the time-domain signal within a desired frequency range. Additionally or alternatively, the device 110 may convert the time-domain signal to the frequency-domain using a Fast Fourier Transform (FFT) and/or the like.

As used herein, audio signals or audio data (e.g., microphone audio data, or the like) may correspond to a specific range of frequency bands. For example, the audio data may correspond to a human hearing range (e.g., 20 Hz-20 kHz), although the disclosure is not limited thereto.

If the device 110 includes a single loudspeaker 114, an acoustic echo canceller (AEC) may perform acoustic echo cancellation for one or more microphone(s) 112. However, if the device 110 includes multiple loudspeakers 114, a multi-channel acoustic echo canceller (MC-AEC) may perform acoustic echo cancellation. For ease of explanation, the disclosure may refer to removing estimated echo audio data from microphone audio data to perform acoustic echo cancellation. The system 100 removes the estimated echo audio data by subtracting the estimated echo audio data from the microphone audio data, thus cancelling the estimated echo audio data. This cancellation may be referred to as "removing," "subtracting" or "cancelling" interchangeably without departing from the disclosure.

In some examples, the device 110 may perform echo cancellation using the playback audio data. However, the disclosure is not limited thereto, and the device 110 may perform echo cancellation using the microphone audio data, such as adaptive noise cancellation (ANC), adaptive interference cancellation (AIC), and/or the like, without departing from the disclosure.

In some examples, such as when performing echo cancellation using ANC/AIC processing, the device 110 may include a beamformer that may perform audio beamforming on the microphone audio data to determine target audio data (e.g., audio data on which to perform echo cancellation). The beamformer may include a fixed beamformer (FBF) and/or an adaptive noise canceller (ANC), enabling the beamformer to isolate audio data associated with a particular direction. The FBF may be configured to form a beam in a specific direction so that a target signal is passed and all other signals are attenuated, enabling the beamformer to select a particular direction (e.g., directional portion of the microphone audio data). In contrast, a blocking matrix may be configured to form a null in a specific direction so that the target signal is attenuated and all other signals are passed (e.g., generating non-directional audio data associated with the particular direction). The beamformer may generate fixed beamforms (e.g., outputs of the FBF) or may generate adaptive beamforms (e.g., outputs of the FBF after removing the non-directional audio data output by the blocking matrix) using a Linearly Constrained Minimum Variance (LCMV) beamformer, a Minimum Variance Distortionless Response (MVDR) beamformer or other beamforming techniques. For example, the beamformer may receive audio input, determine six beamforming directions and output six fixed beamform outputs and six adaptive beamform outputs. In some examples, the beamformer may generate six fixed beamform outputs, six LCMV beamform outputs and six MVDR beamform outputs, although the disclosure is not limited thereto. Using the beamformer and techniques discussed below, the device 110 may determine target signals on which to perform acoustic echo cancellation using the AEC. However, the disclosure is not limited thereto and the device 110 may perform AEC without beamforming the microphone audio data without departing from the present disclosure. Additionally or alternatively, the device 110 may perform beamforming using other techniques known to one of skill in the art and the disclosure is not limited to the techniques described above.

As discussed above, the device 110 may include a microphone array having multiple microphones 112 that are laterally spaced from each other so that they can be used by audio beamforming components to produce directional audio signals. The microphones 112 may, in some instances, be dispersed around a perimeter of the device 110 in order to apply beampatterns to audio signals based on sound captured by the microphone(s). For example, the microphones 112 may be positioned at spaced intervals along a perimeter of the device 110, although the present disclosure is not limited thereto. In some examples, the microphone 112 may be spaced on a substantially vertical surface of the device 110 and/or a top surface of the device 110. Each of the microphones 112 is omnidirectional, and beamforming technology may be used to produce directional audio signals based on audio data generated by the microphones 112. In other embodiments, the microphones 112 may have directional audio reception, which may remove the need for subsequent beamforming.

Using the microphone(s) 112, the device 110 may employ beamforming techniques to isolate desired sounds for purposes of converting those sounds into audio signals for speech processing by the system. Beamforming is the process of applying a set of beamformer coefficients to audio signal data to create beampatterns, or effective directions of gain or attenuation. In some implementations, these volumes may be considered to result from constructive and destructive interference between signals from individual microphones 112 in a microphone array.

The device 110 may include a beamformer that may include one or more audio beamformers or beamforming components that are configured to generate an audio signal that is focused in a particular direction (e.g., direction from which user speech has been detected). More specifically, the beamforming components may be responsive to spatially separated microphone elements of the microphone array to produce directional audio signals that emphasize sounds originating from different directions relative to the device 110, and to select and output one of the audio signals that is most likely to contain user speech.

Audio beamforming, also referred to as audio array processing, uses a microphone array having multiple microphones 112 that are spaced from each other at known distances. Sound originating from a source is received by each of the microphones 112. However, because each microphone is potentially at a different distance from the sound source, a propagating sound wave arrives at each of the microphones 112 at slightly different times. This difference in arrival time results in phase differences between audio signals produced by the microphones. The phase differences can be exploited to enhance sounds originating from chosen directions relative to the microphone array.

Acoustic waves can be visualized as rays emanating from an audio source, especially at a distance from the audio source. For example, the acoustic waves between the audio source and a microphone array can be represented as acoustic plane waves (e.g., planewaves), which correspond to a wave whose wavefronts (e.g., surfaces of constant phase) are parallel planes. Thus, the acoustic plane waves shift with time t from the audio source along a direction of propagation (e.g., in a specific direction) towards the microphone array. Thus, a plane wave $w_p$ may have a first position at a first time $w_p(t)$, a second position at a second time $w_p(t+1)$, a third position at a third time $w_p(t+2)$, a fourth position at a fourth time $w_p(t+3)$, and so on. In addition, acoustic plane waves may have a constant value of magnitude and a linear phase, corresponding to a constant acoustic pressure.

Acoustic plane waves are a good approximation of a far-field sound source (e.g., sound source at a relatively large distance from the microphone array), whereas spherical acoustic waves are a better approximation of a near-field sound source (e.g., sound source at a relatively small distance from the microphone array). For ease of explanation, the disclosure may refer to acoustic waves with reference to acoustic plane waves. However, the disclosure is not limited thereto, and the illustrated concepts may apply to spherical acoustic waves without departing from the disclosure. For example, the device acoustic characteristics data may correspond to acoustic plane waves, spherical acoustic waves, and/or a combination thereof without departing from the disclosure.

Figure 2:
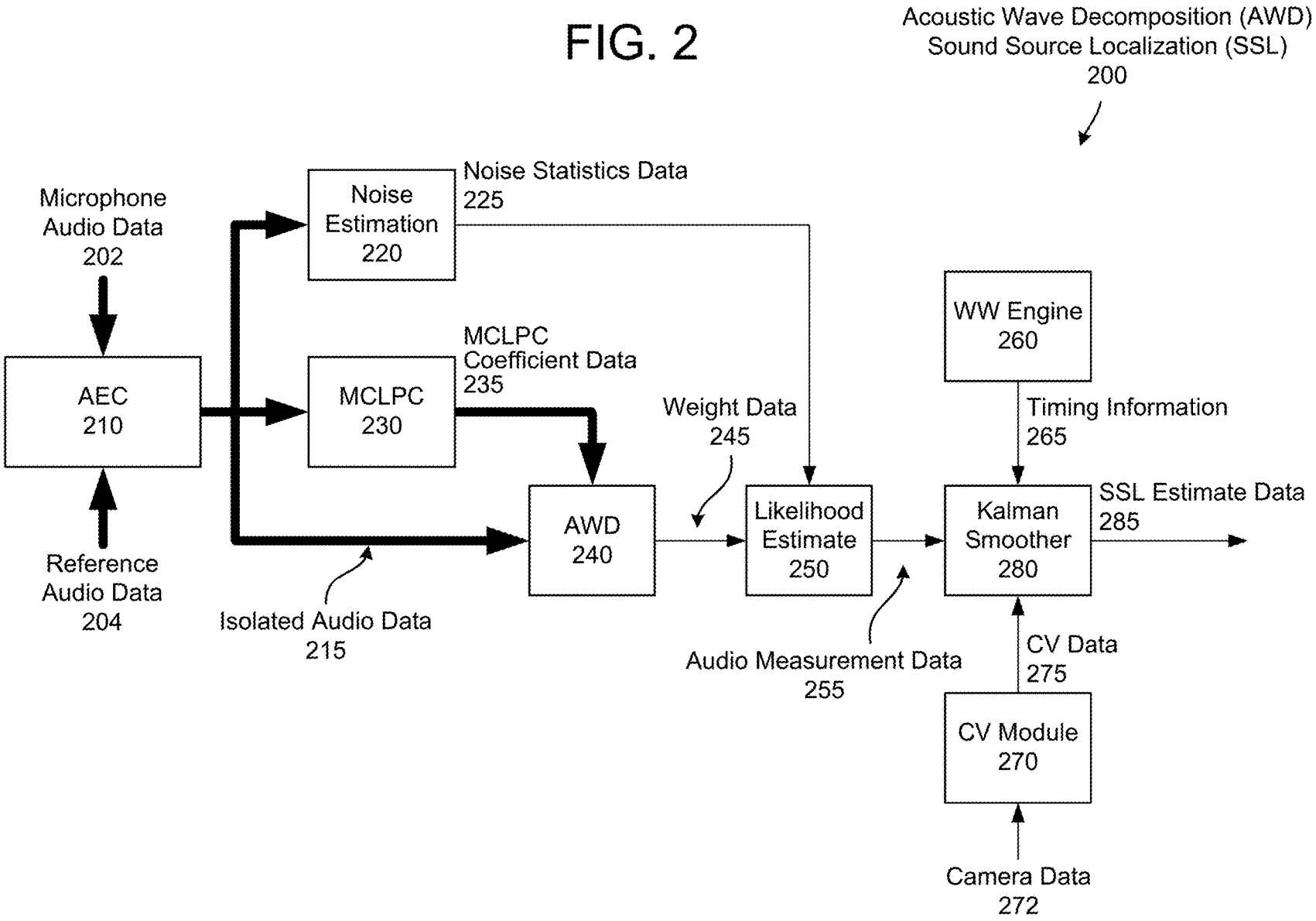
FIG. 2 illustrates an example component diagram for performing SSL using acoustic wave decomposition according to embodiments of the present disclosure.

FIG. 2 illustrates an example component diagram for performing SSL using acoustic wave decomposition according to embodiments of the present disclosure. As illustrated in FIG. 2, acoustic wave decomposition (AWD) sound source localization (SSL) 200 may perform SSL processing using AWD techniques to generate SSL estimate data 285. As used herein, AWD techniques model the observed sound-field at a microphone array at a given frequency as a superposition of acoustic plane waves from multiple directions. For example, if the observed sound field at frequency f and time t is denoted as y(f,t), which is a vector of size m (e.g., m=4 for a microphone array including four microphones), then:

$$y(f,t)=\Sigma_l \alpha_l \varphi(f,\theta_l,\phi_l)+n(f,t) \quad [1]$$

where $\theta_l$ and $\phi_l$ are respectively the azimuth and elevation angles of the l-th acoustic wave component, $\alpha_l$ is the corresponding complex-valued weight, $\varphi(f,\theta_l,\phi_l)$ is the acoustic pressure at the microphone array when an acoustic plane wave from direction $(\theta_l,\phi_l)$ impinges on the device 110, and n(f,t) is the noise component. As used herein, the azimuth $\theta_l$ refers to an angle between 0 and 360 degrees that indicates a direction relative to the device 110 on a horizontal plane, whereas the elevation $\phi_l$ refers to an angle between 0 and 180 degrees that indicates an elevation relative to the device on a vertical plane. The set of acoustic pressure vectors from all directions, $\mathcal{D} \triangleq \{\varphi(f,\theta,\phi)\}_{f,\theta,\phi}$, is computed offline using acoustic simulation techniques (e.g., multiphysics simulation packages) and is referred to as a device acoustic dictionary for the device 110.

The objective of performing SSL processing is to estimate the source azimuth angle (e.g., $\hat{\theta}$) given the microphone array observations at all frequencies within the wakeword, that is:

$$\hat{\theta}=\mathbb{E}\{\theta|\{y(f,t)\}_{f,t}\} \quad [2]$$

where $\mathbb{E}\{.\}$ denotes the conditional expectation operator. This expectation operator is based on the probability of a direction $(\theta, \phi)$, given a single observation $P(\theta, \phi|y(f,t))$; which is computed from the AWD model using Equation [1]. The probability is averaged over all observations in frequency and time to compute the final estimate.

The different components of the estimation procedure are as follows:

1. Noise Estimation component 220: Estimates the energy of the noise component n(f,t) in Equation [1] for the different operating scenarios. Generates noise statistics data 225.
2. Multichannel Linear Prediction Coding (MCLPC) component 230: Whitens the spectrum of the source signal to separate the channel correlation from source correlation. Generates MCLPC coefficient data 235.

3. Acoustic Wave Decomposition (AWD) component 240: Utilizes the AWD model and device acoustic dictionary in Equation [1] to generate weight data 245. The weight data 245 may correspond to a direct solution using the AWD model (e.g., solving a linear system of equations to determine $\alpha_l$) or an approximation of the AWD model (e.g., using cross-correlation as a proxy for component weights to determine $\rho_l$) without departing from the disclosure.
4. Likelihood Estimate component 250: Uses the noise statistics data 225 and the weight data 245 to generate a likelihood function $\Omega(\theta,t)$, which is an approximation of the SSL probability $P(\theta|y(f, t))$. Generates audio measurement data 255 that indicates local maxima (e.g., highest azimuth values) and the corresponding variance.
5. Kalman Smoother component 280: Performs the final temporal smoothing over the audio measurement data 255 to produce the final azimuth estimate $\theta$ as in Equation [2]. Auxiliary sensors information (e.g., camera data) is fused with audio observations. Generates SSL estimate data 285.

The SSL processing must behave uniformly under both quiet and noisy conditions. The noise can be due to external noise (e.g., mechanical noises, television noises, etc.), or due to internal music playback through the loudspeakers 114. Similar to Equation [1], the observed microphone signal y(f, t) can be represented as:

$$y(f,t)=x(f,t)+n(f,t) \quad [3]$$

where x(f, t) is the target wakeword component (which might include reverberation) and n(f, t) is the noise or interference component at frequency f and time t. Let d(f, t) denote the reference playback audio signal. The microphone energy Y(f, t) and the playback energy D(f, t) are computed recursively as:

$$Y(f,t)=(1-\varepsilon)Y(f,t-1)+\varepsilon\|y(f,t)\|^2 \quad [4]$$

$$D(f,t)=(1-\varepsilon)D(f,t-1)+\varepsilon\|d(f,t)\|^2 \quad [5]$$

where $\varepsilon$ is a time constant that is designed to span a few seconds, which is much longer than a typical wakeword duration (e.g., typical time of 500 ms, although the disclosure is not limited thereto). From Equation [3], Y(f, t) is the noise energy estimate in the absence of the wakeword. The microphone-to-playback energy ratio after echo cancellation is performed can be defined as:

$$\eta(f, t) \triangleq \frac{Y(f, t)}{D(f, t)} \quad [6]$$

In general, $\eta(f, t)$ is slowly-varying after echo cancellation convergence. If the period before the wakeword only contains noise, then the instantaneous noise energy during the wakeword can be approximated as:

$$\mathbb{E}\{\|n(f,t)\|^2\}\approx\eta(f,t-\Delta)\cdot\|d(f,t)\|^2 \quad [7]$$

where the delay $\Delta$ is introduced to mitigate the change in $\eta(f, t)$ due to the presence of the wakeword. The Signal-to-Noise Ratio (SNR) value during the wakeword is computed as:

$$\gamma(f, t) = \max\left\{0, \frac{\|y(f, t)\|^2}{\mathbb{E}\|n(f, t)\|^2} - 1\right\} \quad [8]$$

The above $\gamma(f, t)$ summarizes the noise statistics at a single time-frequency cell, and it is used in the AWD processing to compute the angle statistics. Similarly, the total frame SNR value is computed as:

$$\bar{\gamma}(t) = \max\left\{0, \frac{\int\|y(f, t)\|^2}{\int\mathbb{E}\|n(f, t)\|^2} - 1\right\} \quad [9]$$

When there is no playback signal (e.g., d(f, t)=0), Y(f, t) is the average noise floor in the absence of the wakeword, and $\mathbb{E}\{\|n(f,t)\|^2\}\approx Y(f,t-\Delta)$, which resembles noise floor estimation in spectral subtraction methods. In this case, the SNR calculation in Equation [8] is a good approximation if the energy of the background noise wide-sense stationary. Thus, both music playback through internal loudspeakers and external noise are processed using the same procedure.

Linear Prediction Coding (LPC) is a procedure that is used during speech processing. For example, LPC coefficients (e.g., $a=(a_1, a_2 \ldots a_n)^T$) are computed using the Yule-Walker equation:

$$R\cdot a=r \quad [10]$$

where $r=(r(1), r(2) \ldots r(n))^T$, with r(k) denoting the k-th autocorrelation coefficient, and R is n×n autocorrelation matrix with $R_{ij}=r(i-j)$. The Yule-Walker equation is efficiently solved using the Levinson-Durbin algorithm, whose complexity is only $O(n^2)$. Note that the LPC factorizes the speech spectrum (e.g., X(z)) as:

$$X(z)=A(z)\cdot U(z) \quad [11]$$

where A(z) is the autoregressive model of speech, which can be computed from the LPC coefficients a in Equation [10], and U(z) is a z-transform of the LPC residual (e.g., u(t)), which is a white-noise excitation signal that is computed from the speech signal as:

$$u(t) = x(t) - \sum_{l=1}^{n} a_l x(t-l) \quad [12]$$

In the presence of reverberation, the single-channel LPC coefficients combine both the autoregressive model of the source speech (e.g., A(z)) and the channel impulse response (e.g., H(z)), which hinders its modeling gain. Nevertheless, if a microphone array is used and the spacing between the microphones is large enough to randomize the room impulse responses at the different microphones, then the impact of reverberation on the LPC coefficients can be mitigated through Multi-Channel LPC (MCLPC). With MCLPC, the speech signal at the m-th mic (e.g., $X_m(z)$) is modeled as:

$$X_m(z)=A(z)U_m(z) \quad [13]$$

where A(z) represents the autoregressive model of the source speech (as in Equation [11]), and $U_m(z)$ is the MCLPC residual at the m-th microphone, which is:

$$U_m(z)=H_m(z)U(z) \quad [14]$$

where U(z) is the white-noise excitation of the source speech (as in Equation [11]), and $H_m(z)$ is the room impulse response between the source and the m-th microphone. As shown in Equation [14], the MCLPC residual is no longer a white-noise signal, it is the convolution of the room impulse response and a white-noise signal. Thus, it inherits all the properties of the room impulse response, while effectively removing the correlation due to the speech signal. Therefore, the MCLPC residuals at the microphones of the microphone array can be effectively used for sound source localization (SSL) estimation.

The computation of the MCLPC coefficients is simple, as they can be computed from the Yule-Walker equation as:

$$r(k) = \frac{1}{M}\sum_{m=1}^{M} r_m(k) \quad [15]$$

where r(k) denotes the k-th autocorrelation coefficient, M is the number of microphones, and $r_m(k)$ is the ensemble autocorrelation at the m-th microphone. This simple modification averages out the room impulse response at the different microphones in the calculation of the MCLPC coefficients. A single set of the MCLPC coefficients (e.g., r(k)) is computed for all microphones, and the m-th residual signal (e.g., $r_m(t)$) is computed as:

$$u_m(t) = x_m(t) - \sum_{l=1}^{n} a_l x_m(t-l) \quad [16]$$

where $r_m(t)$ denotes the residual signal for the m-th microphone, $x_m(t)$ denotes the speech signal at the m-th microphone, and $a_l$ denotes an individual LPC coefficient of the LPC coefficients a.

The device 110 may generate the SSL estimates from microphone array observations. For example, the AWD component 240 may use the AWD model in Equation [1] to process the microphone signals and the likelihood estimate component 250 may produce audio SSL measurements that are processed by the Kalman Smoother component 280 to generate the final SSL angle estimate. Each SSL measurement generated by the likelihood estimate component 250 may be associated with a variance estimate that reflects its confidence score.

The MCLPC residual has the underlying room information, and it whitens the spectrum of the source signal. Therefore, it provides better SSL information than the raw microphone signal under quiet conditions. However, the MCLPC modeling degrades with lower SNR values, such that the raw microphone signal becomes more reliable. To exploit the benefit of both signals, the AWD is computed twice on MCLPC residuals and raw microphone signals and the corresponding variances of the estimates are adjusted according to the input SNR value.

The objective is to generate measurements for azimuth angles {θ} at each time frame, with confidence measures that are proportional to P(θ|y(f, t)), where P(.|) is the conditional probability. These measurements are based on the weight of each azimuth component, after averaging over frequency and elevation, and they are the inputs to the Kalman smoother component 280.

The direct solution to the AWD problem in Equation [1] computes the least-square solution to the linear system of equations at each time-frequency cell:

$$y(f,t) = (\varphi(f,\theta_1,\phi_1)\ \ \varphi(f,\theta_2,\phi_2)\ \ \ldots\ \ \varphi(f,\theta_N,\phi_N))\begin{pmatrix}\alpha_1\\ \vdots\\ \alpha_N\end{pmatrix} \quad [17]$$

where N is the size of the device acoustic dictionary (e.g., device dictionary). All quantities in Equation [17] are complex-valued. The size of the observation vector is the size of the microphone array (e.g., 4, although the disclosure is not limited thereto), while typically N>100 to have a reasonable representation of the three-dimensional space. Hence, the system of equations in Equation [17] is highly undetermined, and proper regularization is needed to solve it. This regularization is done in two steps:

1. Identify the K strongest components using cross-correlation.
2. Compute regularized least square solution using a pruned dictionary with only the entries of the K strongest entires.

The cross-correlation pi between the observation and the l-th entry in the device dictionary is:

$$\rho_l(f,t) \triangleq \varphi^H(f,\theta_l,\phi_l)y(f,t) \quad [18]$$

The strongest K components are retained for further analysis (e.g., K≤20). To account for the limited directivity of the microphone array, entries that have neighbors with stronger cross-correlation values are discarded, where the neighborhood range is set to 30 degrees. After identifying a small set of components for further investigation, the weights of each component is computed by solving the regularized least square problem:

$$J = \|y(f,t) - A\alpha\|^2 + \lambda\|\alpha\|^2 \quad [19]$$

where A is an 4×K matrix whose columns correspond to the pruned dictionary, and α is a vector with the corresponding weights. This optimization problem is solved using coordinate-descent procedure, where a maximum of 20 iterations is found to be sufficient. The dominant computation in each iteration is the matrix-vector multiplication Aα, After running the above the procedure at each frequency, the partial weights are averaged across frequency for each azimuth angle to produce the final weight at each azimuth.

The full AWD decomposition process requires solving the optimization problem in Equation [19] at each frequency, which significantly increases the computational requirements. Rather than computing the full weights, the cross-correlation with each component as in Equation [18] is used as a proxy for component weights. This resembles the matched filter detector which is the optimal detector for a signal in additive white Gaussian noise. However, it is an approximation as multiple components exist in the observed signal and the entries in the device dictionary are not orthogonal. Despite this, when combined with averaging over frequency and elevation angles, it is an effective approximation. The likelihood function Ω(θ, t) is computed by averaging matched filter score for the azimuth angle θ as:

$$\Omega(\theta,t) = \int_{f_{min}}^{f_{max}} W(f,t)\Sigma_{\theta_l=\theta}|\rho_l(f,t) \quad [20]$$

where W(f, t) is a frequency weighting function that reflects the relative contribution of each frequency, and the inner sum averages the matched filter score of the azimuth angle θ across all elevations (with equal probabilities to all elevations). If full AWD decomposition is used, then $\rho_l$ in Equation [20] is replaced by $\alpha_l$ after solving Equation [19]. The frequency weighting function is shown below:

$$W(f, t) = \frac{\Gamma(\gamma(f, t))}{\|y(f, t)\|^2} \quad [21]$$

where $\gamma(f, t)$ is the SNR as in Equation [8], $\Gamma(.)$ is a sigmoid function. The SNR $\gamma(f, t)$ is computed from the raw microphone measurements and the same value is used for scaling both MCLPC and raw microphone components. The SNR weighting aims to adjust the confidence of each frequency measurement according to its SNR, while the amplitude weighting provides frequency normalization across the frequency range of interest $[f_{min}, f_{max}]$.

The likelihood function $\Omega(\theta, t)$ in Equation [20] is an approximation of the SSL probability $P(\theta|\{y(f, t)\}_f)$. If only a single time frame is observed, then the azimuth angle that maximizes $\Omega(\theta, t)$ is the maximum-likelihood estimation. In some examples, the device 110 may use multiple time frames that span the duration of the wakeword, and all estimates within this wakeword period are averaged using the Kalman Smoother component 280. The likelihood function provides measurements to the Kalman Smoother component 280 at each time frame, where each measurement consists of an azimuth estimate and the corresponding variance.

The likelihood function $\Omega(\theta, t)$ is a multimodal function that approximates a Gaussian mixture:

$$\Omega(\theta,t)=\Sigma_l\delta_l N(\mu_l,\sigma_l^2) \quad [22]$$

The measurements to the Kalman Smoother component 280 at time t are the local maxima of $\Omega(\theta, t)$, which corresponds to the Gaussian means $\{\mu_l\}$. To refine the measurements, only local maxima within a threshold c are retained, and a bound is set on the number of measurements per frame due to the implementation constraints. The corresponding variance vi is computed to reflect both its relative weight and variance as:

$$v_l = \frac{\delta_l - \epsilon}{\Sigma_k \delta_k - \epsilon}\hat{\sigma}_l^2 \quad [23]$$

where $\hat{\sigma}_l^2$ is the estimated variance of the l-th Gaussian component in Equation [22], which is the square of the standard deviation at which $\Omega(\theta, t)$ in Equation [22] drops to $0.67\delta_l$.

The device 110 performs this procedure for both MCLPC component and raw microphone component. A control mechanism for the relative variance of the raw component and the MCLPC component:

1. The variance of all measurements of the MCLPC component is increased by a constant factor if the total SNR in Equation [9] of the frame is smaller than a threshold value (e.g., 5 dB).
2. Otherwise, the variance of all measurements of the MCLPC component is decreased by a ratio that is proportional to the MCLPC gain. Similarly, the variance of the raw component is increased by a ratio that is proportional to the MCLPC gain.

The device dictionary (e.g., device acoustic characteristics data) is the collection of acoustic pressure vectors ($\{\varphi(f,\theta_l,\phi_l\}$ in Equation [1]) that represent the device response when an acoustic plane wave from direction $(\theta_l, \phi_l)$ impinges on the device 110. The device dictionary may be calculated once for the device 110. The device acoustic characteristics data represents the acoustic response of the device to each acoustic plane-wave of interest, completely characterizing the device behavior for each acoustic plane-wave. Thus, the system 100 may use the device acoustic characteristics data to accommodate for the acoustic wave scattering due to the device surface. Each entry of the device acoustic characteristics data has the form $\{\varphi(f,\leftarrow_l,\phi_l)$, which represents the acoustic pressure vector (at all microphones) at frequency f, for an acoustic plane-wave of azimuth $\theta_l$ and elevation $\phi_l$. Thus, a length of each entry of the device acoustic characteristics data corresponds to a number of microphones included in the microphone array.

In some examples, the system 100 may calculate an acoustic pressure at each microphone (at each frequency) by solving the Helmholtz equation numerically with a background acoustic wave. This procedure is repeated for each possible acoustic wave and each possible direction to generate a full dictionary that completely characterizes a behavior of the device 110 for each acoustic wave (e.g., device response for each acoustic wave). Thus, the system 100 may simulate the device acoustic characteristics data without departing from the disclosure.

In other examples, the system 100 may determine the device acoustic characteristics data by physical measurement in an anechoic room. For example, the system 100 may measure acoustic pressure values at each of the microphones in response to an input (e.g., impulse) generated by a loudspeaker. The input may correspond to white noise or other waveforms, and may include a frequency sweep across all frequency bands of interest (e.g., input signal includes white noise within all desired frequency bands).

To model all of the potential acoustic waves, the system 100 may generate the input using the loudspeaker in all possible locations in the anechoic room. For example, the loudspeaker may generate inputs at multiple source locations along a horizontal direction, such as a first input at a first source location, a second input at a second source location, and so on until an n-th input at an n-th source location. Thus, the loudspeaker generates the input at every possible source location associated with a first horizontal row. In addition, the system 100 may generate the input using the loudspeaker at every possible source location in every horizontal row without departing from the disclosure. Thus, the loudspeaker may generate inputs at every possible source location throughout the anechoic room, until finally generating a z-th input at a z- the source location.

As described above, the device surface component is determined by simulating or measuring the scattered acoustic pressure at each microphone on the device for each incident acoustic plane wave. Because of the linearity of the wave equation, the total acoustic pressure at each microphone on the device surface is determined using the superposition of plane wave responses from the device surface component (e.g., the device response to each plane wave).

Referring back to FIG. 2, in some examples the device 110 may perform AWD SSL processing 200 while performing echo cancellation using an acoustic echo canceller (AEC) component 210. For example, the AEC component 210 may receive microphone audio data 202 and reference audio data 204 and may perform echo cancellation to remove the reference audio data 204 from the microphone audio data 202 to generate isolated audio data 215. In this example, the device 110 may determine the playback energy D(f, t) using the reference audio data 204.

While FIG. 2 illustrates an example in which the AEC component 210 performs echo cancellation, the disclosure is not limited thereto and in other examples the device 110 may perform AWD SSL processing 200 without performing echo cancellation without departing from the disclosure. For example, the AEC component 210 may pass the microphone audio data 202 without performing echo cancellation, such that the isolated audio data 215 is the same as the microphone audio data 202. Additionally or alternatively, the device 110 may omit the AEC component 210 and may pass the microphone audio data 202 to the noise estimation component 220, the MCLPC component 230, and/or the AWD component 240 without departing from the disclosure. In this example, the device 110 may determine that the playback energy D(f, t) is equal to a fixed value.

The noise estimation component 220 may receive the isolated audio data 215 and may generate noise statistics data 225, as described above with regard to Equations [3]-[9]. For example, the noise estimation component 220 may determine a first portion of the first audio data associated with the wakeword and a second portion of the first audio data preceding the first portion. While not illustrated in FIG. 2, the noise estimation component 220 may receive timing information 265 from the wakeword (WW) engine 260. The noise estimation component 220 may determine a microphone energy level associated with the first portion and a noise energy level associated with the second portion (e.g., energy of the noise component n(f, t)), which may both be included in the noise statistics data 225 although the disclosure is not limited thereto. Using the microphone energy level and the noise energy level, the noise estimation component 220 may generate Signal-to-Noise Ratio (SNR) data that may include SNR values for an individual time-frequency cell and/or a total frame SNR value. Thus, the noise statistics data 225 may the noise energy level, the microphone energy level, and/or the SNR data without departing from the disclosure.

The Multi-Channel Linear Prediction Coding (MCLPC) component 230 may receive the isolated audio data 215 and may generate MCLPC coefficient data 235 using any techniques without departing from the disclosure. For example, the MCLPC component 230 may generate the MCLPC coefficient data 235 as described above with regard to Equations [10]-[16], which may effectively whiten the spectrum of the source signal to separate the channel correlation from source correlation.

The AWD component 240 may receive the isolated audio data 215 and/or the MCLPC coefficient data 235 and may generate weight data 245, as described above with regard to Equations [17] and [19] or Equations [18]-[19]. For example, the AWD component 240 may utilize the AWD model and device acoustic dictionary in Equation [1] to generate the weight data 245. In some examples, the AWD component 240 may generate the weight data 245 by calculating a direct solution using the AWD model, as in Equations [17] and [19] (e.g., solving a linear system of equations to determine $\alpha_l$). Alternatively, the AWD component 240 may generate the weight data 245 using an approximation of the AWD model, as in Equations [18]-[19] (e.g., using cross-correlation as a proxy for component weights to determine $\rho_l$) without departing from the disclosure.

In some examples, the AWD component 240 may perform the full decomposition (e.g., generate $\alpha_l$) or approximate the decomposition (e.g., generate $\rho_l$) twice, once using the isolated audio data 215 and once using the MCLPC coefficient data 235. Thus, the weight data 245 may include two sets of values, a first set calculated using the isolated audio data 215 and a second set calculated using the MCLPC coefficient data 235. As the MCLPC residual has the underlying room information and whitens the spectrum of the source signal, the second set may provide better SSL information under quiet conditions. However, the MCLPC modeling degrades with lower SNR values, such that the microphone audio data 202 becomes more reliable and the first set provides better SSL information. Thus, by including both sets in the weight data 245, the device 110 may exploit the benefit of both signals as the likelihood estimate component 250 may adjust the variances of the estimates according to the input SNR.

The likelihood estimate component 250 may receive the noise statistics data 225 and the weight data 245 and may generate audio measurement data 255. For example, the likelihood estimate component 250 may generate a likelihood function $\Omega(\theta,t)$, which is an approximation of the SSL probability $P(\theta|y(f, t))$, using Equations [20]-[21]. Equation [20] illustrates an example of solving for the likelihood function $\Omega(\theta,t)$ when the weight data 245 includes the cross-correlation data pi calculated using Equations [18]-[19]. However, the disclosure is not limited thereto and in other examples, $\rho_l$ can be replaced with $\alpha_l$ when the full acoustic wave decomposition is used.

While the likelihood estimate component 250 generates the likelihood function $\Omega(\theta,t)$, the likelihood estimate component 250 does not output the likelihood function $\Omega(\theta,t)$. Instead, the likelihood estimate component 250 outputs audio measurement data 255 that includes local maxima (e.g., highest azimuth values) and the corresponding variance, as described above with regard to Equations [22]-[23]. For example, the likelihood estimate component 250 may determine one or more local maxima of $\Omega(\theta,t)$ at time t, which correspond to the Gaussian means $\mu_l$. To refine the measurements, only local maxima within a threshold E are retained, and a bound is set on the number of measurements per frame due to implementation constraints. Thus, Equation [23] can be used to compute a corresponding variance that reflects both the relative weight and variance for the local maxima.

As described above, the AWD component 240 may perform the full decomposition (e.g., generate $\alpha_l$) or approximate the decomposition (e.g., generate $\rho_l$) twice, once using the isolated audio data 215 and once using the MCLPC coefficient data 235. Thus, the weight data 245 may include two sets of weight values, a first set calculated using the isolated audio data 215 and a second set calculated using the MCLPC coefficient data 235. The likelihood estimate component 250 may generate the audio measurement data 255 using both sets of weight values. For example, the likelihood estimate component 250 may generate a first portion of the audio measurement data 255 (e.g., first local maxima and corresponding variance) using the first set of weight values and a second portion of the audio measurement data 255 (e.g., second local maxima and corresponding variance) using the second set of weight values.

As described above with regard to Equations [20]-[21], the likelihood estimate component 250 generates the likelihood function $\Omega(\theta,t)$ in part based on the SNR value calculated using Equation [8] and included in the noise statistics data 225. For example, the SNR value is calculated using the microphone audio data 202 and the same SNR value is used in Equation [20] for scaling both the first set of weight values (e.g., isolated audio data 215) in a first likelihood function and the second set of weight values (e.g., MCLPC coefficient data 235) in a second likelihood function. This SNR weighting adjusts the confidence of each frequency measurement according to its SNR value.

In some examples, the SNR value may be used to modify the variances calculated by the likelihood estimate component 250. For example, the variance of all measurements of the MCLPC component (e.g., variance corresponding to local maxima calculated using the second set of weight values in the second likelihood function) may be increased by a constant factor if the total SNR value of the frame (e.g., calculated using Equation [9]) is smaller than a threshold value (e.g., 5 dB). Otherwise, the variance of all measurements of the MCLPC component may be decreased by a ratio that is proportional to the MCLPC gain. Similarly, the variance of all measurements of the microphone component (e.g., variance corresponding to local maxima calculated using the first set of weight values in the first likelihood function) may be increased by a ratio that is proportional to the MCLPC gain. By increasing and decreasing the variances, the device 110 may adjust a relative weighting between the MCLPC component and the microphone component (e.g., raw component) based on the SNR value, prioritizing the MCLPC component under quiet conditions (e.g., high SNR value) and prioritizing the microphone component under noisy conditions (e.g., low SNR value).

The Kalman smoother component 280 may receive the audio measurement data 255 and perform final temporal smoothing to produce the final azimuth estimate θ as in Equation [2]. For example, the Kalman smoother component 280 may receive a plurality of local maxima that vary over a period of time and may generate SSL estimate data 285 that indicates a single azimuth estimate θ for a single sound source. Thus, the SSL estimate data 285 may include SSL estimates for multiple sound sources, but each sound source corresponds to a single azimuth estimate θ.

As part of generating the SSL estimate data 285, the Kalman smoother component 280 may receive the timing information 265 from the wakeword engine 260 and/or the computer vision (CV) data 275 from a CV module component 270. For example, the wakeword engine 260 may generate timing information 265 indicating when the wakeword is detected in the microphone audio data 202 and the Kalman smoother 280 may only generate the SSL estimate data 285 when a wakeword is detected, although the disclosure is not limited thereto.

In some examples, the CV module component 270 may receive camera data 272 from a camera (e.g., image sensor) of the device 110 and may process the camera data 272 to generate the CV data 275. For example, the camera data 272 may include image data and the CV module component 270 may process the image data to determine that a wall is represented in certain directions (e.g., azimuths) relative to the device 110. As a result, the CV module component 270 may generate CV data 275 that includes low relative weights for each of the azimuths, indicating to the Kalman smoother component 280 the directions that are associated with the wall and can therefore be ignored. Thus, the Kalman smoother component 280 may generate the SSL estimate data 285 based on the CV data 275, such that the final azimuth value θ does not correspond to the directions associated with the wall.

Additionally or alternatively, the CV module component 270 may perform object detection using the image data to determine that a user is represented in a first direction (e.g., first azimuth) relative to the device 110. As a result, the CV module component 270 may generate CV data 275 that includes a high relative weight for the first azimuth, indicating to the Kalman smoother component 280 that the user is detected in the first direction. Thus, the Kalman smoother component 280 may generate the SSL estimate data 285 based on the CV data 275, such that the final azimuth value θ may correspond to the first direction in which the user was detected, although the disclosure is not limited thereto.

Figure 3:
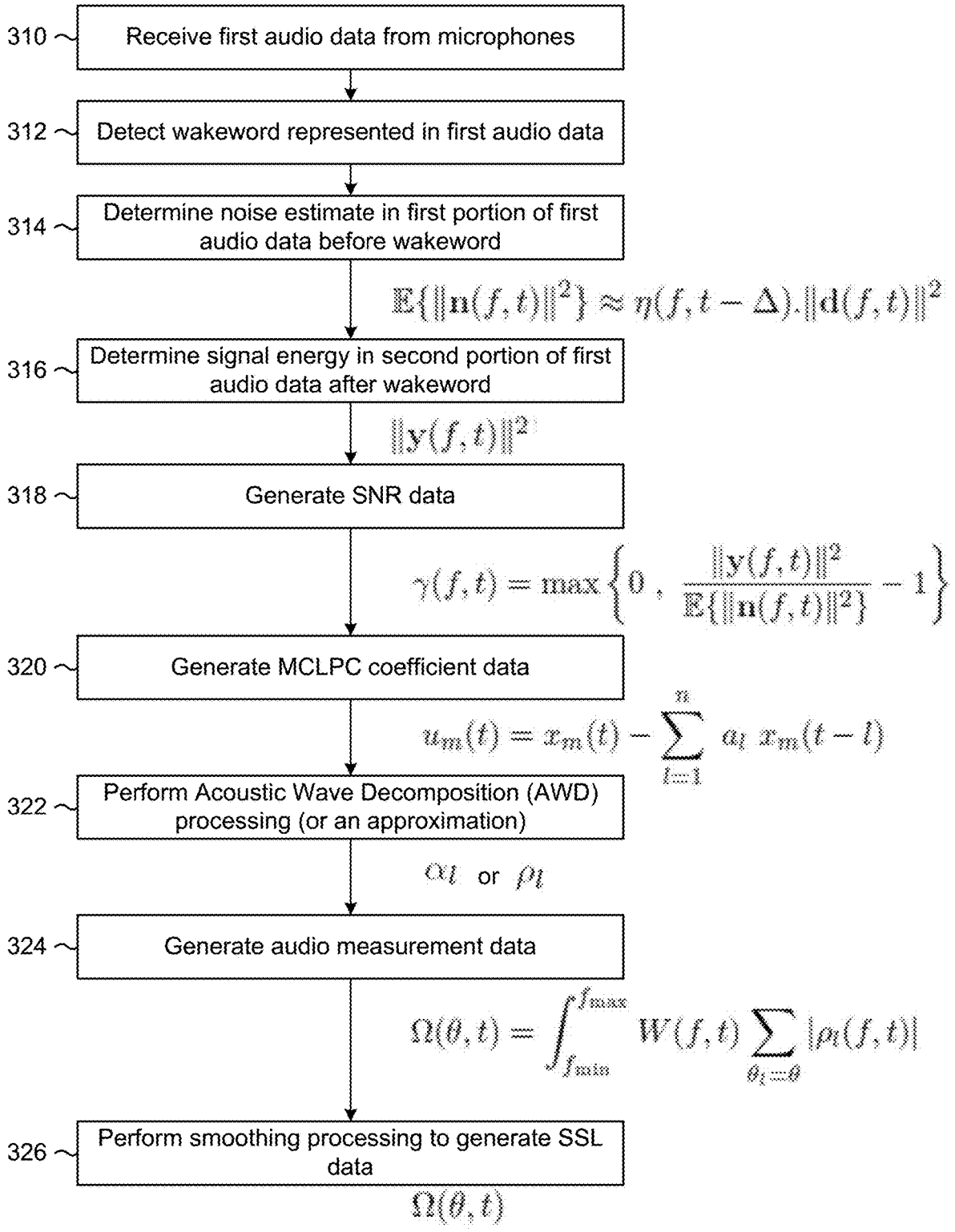
FIG. 3 illustrates a flowchart conceptually illustrating an example method for performing SSL using acoustic wave decomposition according to embodiments of the present disclosure.

FIG. 3 illustrates a flowchart conceptually illustrating an example method for performing SSL using acoustic wave decomposition according to embodiments of the present disclosure. As illustrated in FIG. 3, the device 110 may receive (310) first audio data (e.g., y(f,t)) from the microphones 112. For example, the microphones 112 may capture audible sound(s) generated by one or more sound sources and may generate the first audio data representing the audible sounds. To illustrate an example, when the user 5 is speaking a voice command, the microphones 112 may capture the voice command and generate the first audio data representing the voice command. As described above, the first audio data may include two or more channels (e.g., separate audio signals) based on the number of microphones 112 used to generate the first audio data. For example, the first audio data may include a first audio signal corresponding to a first microphone 112*a* and a second audio signal corresponding to a second microphone 112*b*, although the disclosure is not limited thereto.

The device 110 may detect (312) a wakeword represented in the first audio data. For example, the wakeword engine component 260 may determine that the wakeword is represented in the first audio data beginning at a first time. The device 110 may determine (314) a noise estimate in a first portion of the first audio data before the wakeword (e.g., first time range prior to the first time), as described above with regard to Equation [7], may determine (316) a signal energy in a second portion of the first audio data after the wakeword (e.g., second time range following the first time), and may generate (318) SNR data using the signal energy and the noise estimate, as described above with regard to Equation [8]. In some examples, the SNR data may include a total frame SNR value computed using Equation [9], although the disclosure is not limited thereto.

The device 110 may generate (320) MCLPC coefficient data as described in greater detail above with regard to FIG. 2. For example, the MCLPC component 230 may receive the first audio data and generate MCLPC coefficient data 235 using Equations [10]-[16], although the disclosure is not limited thereto.

The device 110 may perform (322) acoustic wave decomposition processing or an approximation to generate weight values. For example, the AWD component 240 may perform the full decomposition to generate $\alpha_l$ or approximate the decomposition to generate $\rho_l$, as described in greater detail above with regard to FIG. 2. The device 110 may perform the detailed or approximate AWD processing twice, generating a first set of weight values using the first audio data and a second set of weight values using the MCLPC coefficient data.

The device 110 may use these weight values to generate (324) audio measurement data as described above with regard to the likelihood estimate component 250. For example, the device 110 may generate a likelihood function and determine local maxima and the corresponding variance using the likelihood function. The device 110 may then perform (326) smoothing processing to generate the SSL data as described above with regard to the Kalman smoother component 280.

Figure 4:
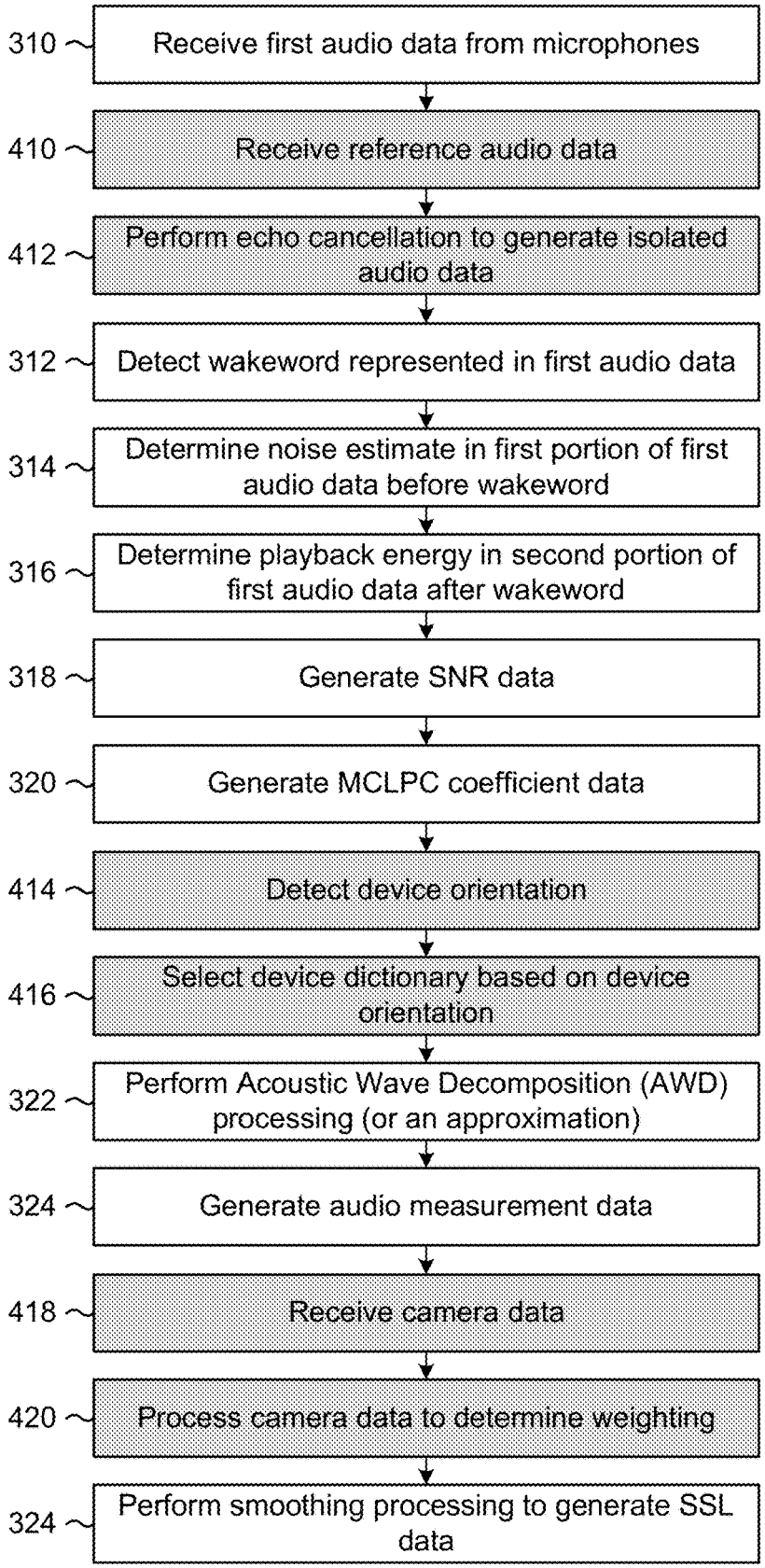
FIG. 4 illustrates a flowchart conceptually illustrating an example method for performing SSL using acoustic wave decomposition according to embodiments of the present disclosure.

FIG. 4 illustrates a flowchart conceptually illustrating an example method for performing SSL using acoustic wave decomposition according to embodiments of the present disclosure. As many of the method steps illustrated in FIG. 4 were previously described with regard to FIG. 3, a corresponding description is omitted.

As illustrated in FIG. 4, in some examples the device 110 may receive (310) the first audio data from the microphone(s) 112, may receive (410) reference audio data, and may perform (412) echo cancellation to generate isolated audio data. Thus, the device 110 may remove an echo signal corresponding to output audio generated by the loudspeaker(s) 114, although the disclosure is not limited thereto. As illustrated in FIG. 4, the device 110 may perform steps 312-320 as described above with regard to FIG. 3. However, while steps 312-316 refer to the first audio data, when echo cancellation is performed these steps may be performed using the isolated audio data instead of the first audio data without departing from the disclosure.

Prior to step 322, the device 110 may detect (414) a device orientation and may select (416) a device dictionary based on the device orientation. For example, the device 110 may detect a tilt of a display of the device 110 and select a device dictionary corresponding to the tilt. In some examples, the device 110 may select between two device dictionaries based on the tilt of the display, although the disclosure is not limited thereto and the device 110 may select from a plurality of device dictionaries without departing from the disclosure. However, the disclosure is not limited thereto, as the device orientation does not always correspond to the tilt of the device 110 and/or the device 110 may detect the device orientation using multiple techniques without departing from the disclosure. For example, the device orientation may correspond to a geometry form factor of the device, which may impact the device acoustics. Thus, the device 110 may estimate the device acoustics by selecting from two or more device dictionaries based on the device orientation without departing from the disclosure.

Prior to step 324, the device 110 may receive (418) camera data and may process (420) the camera data to determine weighting, as described above with regard to the CV module component 270. For example, the device 110 may process image data to detect object(s), user(s), wall(s) or other blank spaces, and/or the like, and may generate weighting indicating a relative weight for each azimuth. To illustrate an example, a first azimuth associated with a user may have a high weight value, whereas a second azimuth or range of azimuths associated with a wall or other blank space may have a low weight value, although the disclosure is not limited thereto.

Figure 5:
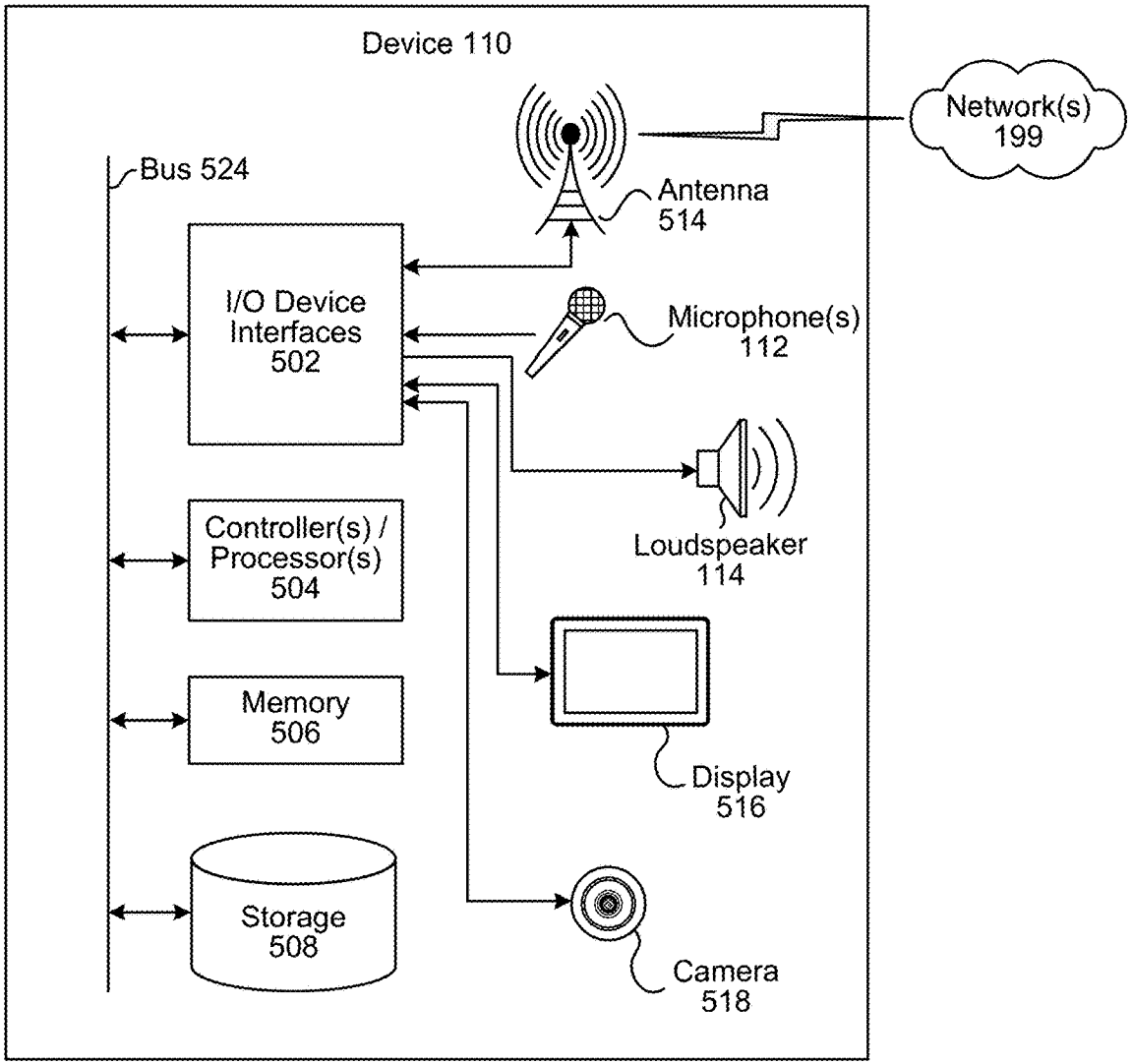
FIG. 5 is a block diagram conceptually illustrating example components of a system according to embodiments of the present disclosure.

FIG. 5 is a block diagram conceptually illustrating a device 110 that may be used with the system. In operation, the system 100 may include computer-readable and computer-executable instructions that reside on the device 110, as will be discussed further below. As illustrated in FIG. 5, each device 110 may include one or more controllers/processors (504), which may each include a central processing unit (CPU) for processing data and computer-readable instructions, and a memory (506) for storing data and instructions of the respective device. The memories (506) may individually include volatile random access memory (RAM), non-volatile read only memory (ROM), non-volatile magnetoresistive memory (MRAM), and/or other types of memory. Each device 110 may also include a data storage component (508) for storing data and controller/processor-executable instructions. Each data storage component (508) may individually include one or more non-volatile storage types such as magnetic storage, optical storage, solid-state storage, etc. Each device 110 may also be connected to removable or external non-volatile memory and/or storage (such as a removable memory card, memory key drive, networked storage, etc.) through respective input/output device interfaces (502).

Computer instructions for operating each device 110 and its various components may be executed by the respective device's controller(s)/processor(s) (504), using the memory (506) as temporary "working" storage at runtime. A device's computer instructions may be stored in a non-transitory manner in non-volatile memory (506), storage (508), or an external device(s). Alternatively, some or all of the executable instructions may be embedded in hardware or firmware on the respective device in addition to or instead of software.

Each device 110 includes input/output device interfaces (502). A variety of components may be connected through the input/output device interfaces (502), as will be discussed further below. Additionally, each device 110 may include an address/data bus (524) for conveying data among components of the respective device. Each component within a device 110 may also be directly connected to other components in addition to (or instead of) being connected to other components across the bus (524).

Referring to FIG. 5, the device 110 may include input/output device interfaces 502 that connect to a variety of components such as an audio output component such as a loudspeaker(s) 114, a wired headset or a wireless headset (not illustrated), or other component capable of outputting audio. The device 110 may also include an audio capture component. The audio capture component may be, for example, microphone(s) 112 or array of microphones, a wired headset or a wireless headset (not illustrated), etc. If an array of microphones is included, approximate distance to a sound's point of origin may be determined by acoustic localization based on time and amplitude differences between sounds captured by different microphones of the array. The device 110 may additionally include a display 516 for displaying content and/or a camera 518 to capture image data, although the disclosure is not limited thereto.

Via antenna(s) 514, the input/output device interfaces 502 may connect to one or more networks 199 via a wireless local area network (WLAN) (such as WiFi) radio, Bluetooth, and/or wireless network radio, such as a radio capable of communication with a wireless communication network such as a Long Term Evolution (LTE) network, WiMAX network, 3G network, 4G network, 5G network, etc. A wired connection such as Ethernet may also be supported. Through the network(s) 199, the system may be distributed across a networked environment. The I/O device interface (502) may also include communication components that allow data to be exchanged between devices such as different physical servers in a collection of servers or other components.

The components of the device(s) 110 may include their own dedicated processors, memory, and/or storage. Alternatively, one or more of the components of the device(s) 110 may utilize the I/O interfaces (502), processor(s) (504), memory (506), and/or storage (508) of the device(s) 110. As noted above, multiple devices may be employed in a single system. In such a multi-device system, each of the devices may include different components for performing different aspects of the system's processing. The multiple devices may include overlapping components. The components of the device(s) 110, as described herein, are illustrative, and may be located as a stand-alone device or may be included, in whole or in part, as a component of a larger device or system.

The concepts disclosed herein may be applied within a number of different devices and computer systems, including, for example, general-purpose computing systems, speech processing systems, and distributed computing environments.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. Persons having ordinary skill in the field of computers and speech processing should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk, and/or other media. In addition, components of system may be implemented in different forms of software, firmware, and/or hardware, such as an acoustic front end (AFE), which comprises, among other things, analog and/or digital filters (e.g., filters configured as firmware to a digital signal processor (DSP)). Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements, and/or steps are in any way required for one or more embodiments or that one or more embodiments necessarily include logic for deciding, with or without other input or prompting, whether these features, elements, and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Disjunctive language such as the phrase "at least one of X, Y, Z," unless specifically stated otherwise, is understood with the context as used in general to present that an item, term, etc., may be either X, Y, or Z, or any combination thereof (e.g., X, Y, and/or Z). Thus, such disjunctive language is not generally intended to, and should not, imply that certain embodiments require at least one of X, at least one of Y, or at least one of Z to each be present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising:

receiving first audio data, a first portion of the first audio data corresponding to a first microphone of a device and a second portion of the first audio data corresponding to a second microphone of the device;

determining first coefficient data associated with the first audio data, the first coefficient data corresponding to the first microphone and the second microphone;

detecting speech represented during a first period of time within the first audio data, the speech generated by a user;

determining first energy data associated with a second period of time within the first audio data, the second period of time preceding the first period of time;

determining, using the first audio data, first weight data;

determining, using the first coefficient data, second weight data; and determining, using the first weight data, the second weight data, and the first energy data, that the user is in a first direction relative to the device.

2. The computer-implemented method of claim 1, wherein determining that the user is in the first direction further comprises:

determining first signal quality metric data using the first energy data and second energy data, the second energy data associated with a first portion of the first period of time;

and generating, using the first weight data and the first signal quality metric data, first data, the first data indicating that the first direction corresponds to a first local maxima of a first function.

3. The computer-implemented method of claim 2, wherein determining that the user is in the first direction further comprises:

determining second signal quality metric data using the first energy data and third energy data, the third energy data associated with a second portion of the first period of time;

generating, using the first weight data and the second signal quality metric data, second data, the second data indicating that a second direction corresponds to a second local maxima of a second function; and determining, based on the first data and the second data, that the user is in the first direction.

4. The computer-implemented method of claim 1, wherein determining that the user is in the first direction further comprises:

determining first signal quality metric data using the first energy data and second energy data, the second energy data associated with the first period of time;

generating, using the first weight data and the first signal quality metric data, first data, the first data indicating that the first direction corresponds to a first local maxima of a first function;

determining first variance data corresponding to the first data; and determining, based on the first data and the first variance data, that the user is in the first direction.

5. The computer-implemented method of claim 4, wherein determining that the user is in the first direction further comprises:

generating, using the second weight data and the first signal quality metric data, second data, the second data indicating that a second direction corresponds to a second local maxima of a second function;

determining second variance data corresponding to the second data; and determining, using the first data, the first variance data, the second data, and the second variance data, that the user is in the first direction.

6. The computer-implemented method of claim 1, further comprises:

determining that a beginning of the first period of time corresponds to a beginning of the speech;

determining second energy data associated with the first period of time; and determining signal quality metric data using the first energy data and the second energy data.

7. The computer-implemented method of claim 1, further comprising:

determining first signal quality metric data using the first energy data and second energy data, the second energy data associated with the first period of time;

generating, using the second weight data and the first signal quality metric data, first data, the first data including a first mean value and a first variance value;

determining a first signal quality metric value using the first signal quality metric data;

determining that the first signal quality metric value is below a threshold value;

determining a second variance value by multiplying the first variance value by a first value; and determining, based on the first mean value and the second variance value, that the user is in the first direction.

8. The computer-implemented method of claim 1, further comprising:

receiving image data from a camera associated with the device;

detecting an object represented in the image data, the object being in a second direction relative to the device;

generating a weighting vector that associates the second direction with a first value and remaining directions with a second value; and determining, based on the first weight data, the second weight data, the first energy data, and the weighting vector, that the user is in the first direction relative to the device.

9. The computer-implemented method of claim 1, further comprising:

receiving first sensor data indicating that the device is in a first orientation;

determining first acoustic characteristics data corresponding to the first orientation;

determining the first weight data using the first acoustic characteristics data and the first audio data, the first weight data associated with a first portion of the first period of time;

receiving second sensor data indicating that the device is in a second orientation;

determining second acoustic characteristics data corresponding to the second orientation;

determining third weight data using the second acoustic characteristics data and the first audio data, the third weight data associated with a second portion of the first period of time; and determining, using the third weight data, that the user is in a second direction relative to the device during the second portion of the first period of time.

10. A system comprising:

at least one processor; and memory including instructions operable to be executed by the at least one processor to cause the system to:

receive first audio data, a first portion of the first audio data corresponding to a first microphone of a device and a second portion of the first audio data corresponding to a second microphone of the device;

determine first coefficient data associated with the first audio data, the first coefficient data corresponding to the first microphone and the second microphone;

detect speech represented during a first period of time within the first audio data, the speech generated by a user;

determine first energy data associated with a second period of time within the first audio data, the second period of time preceding the first period of time;

determine, using the first audio data, first weight data;

determine, using the first coefficient data, second weight data; and determine, using the first weight data, the second weight data, and the first energy data, that the user is in a first direction relative to the device.

11. The system of claim 10, wherein the memory further comprises instructions that, when executed by the at least one processor, further cause the system to:

determine first signal quality metric data using the first energy data and second energy data, the second energy data associated with a first portion of the first period of time; and generate, using the first weight data and the first signal quality metric data, first data, the first data indicating that the first direction corresponds to a first local maxima of a first function.

12. The system of claim 11, wherein the memory further comprises instructions that, when executed by the at least one processor, further cause the system to:

determine second signal quality metric data using the first energy data and third energy data, the third energy data associated with a second portion of the first period of time;

generate, using the first weight data and the second signal quality metric data, second data, the second data indicating that a second direction corresponds to a second local maxima of a second function; and determine, based on the first data and the second data, that the user is in the first direction.

13. The system of claim 10, wherein the memory further comprises instructions that, when executed by the at least one processor, further cause the system to:

determine first signal quality metric data using the first energy data and second energy data, the second energy data associated with the first period of time;

generate, using the first weight data and the first signal quality metric data, first data, the first data indicating that the first direction corresponds to a first local maxima of a first function;

determine first variance data corresponding to the first data; and determine, based on the first data and the first variance data, that the user is in the first direction.

14. The system of claim 13, wherein the memory further comprises instructions that, when executed by the at least one processor, further cause the system to:

generate, using the second weight data and the first signal quality metric data, second data, the second data indicating that a second direction corresponds to a second local maxima of a second function;

determine second variance data corresponding to the second data; and determine, using the first data, the first variance data, the second data, and the second variance data, that the user is in the first direction.

15. The system of claim 10, wherein the memory further comprises instructions that, when executed by the at least one processor, further cause the system to:

determine that a beginning of the first period of time corresponds to a beginning of the speech;

determine second energy data associated with the first period of time; and determine signal quality metric data using the first energy data and the second energy data.

16. The system of claim 10, wherein the memory further comprises instructions that, when executed by the at least one processor, further cause the system to:

receive first sensor data indicating that the device is in a first orientation;

determine first acoustic characteristics data corresponding to the first orientation;

determine the first weight data using the first acoustic characteristics data and the first audio data, the first weight data associated with a first portion of the first period of time;

receive second sensor data indicating that the device is in a second orientation;

determine second acoustic characteristics data corresponding to the second orientation;

determine third weight data using the second acoustic characteristics data and the first audio data, the third weight data associated with a second portion of the first period of time; and determine, using the third weight data, that the user is in a second direction relative to the device during the second portion of the first period of time.

17. A computer-implemented method, the method comprising:

receiving first audio data corresponding to two or more microphones of a device;

detecting speech represented during a first period of time within the first audio data, the speech generated by a user;

determining first energy data associated with a second period of time within the first audio data, the second period of time preceding the first period of time;

determining first weight data, the first weight data corresponding to a first cross-correlation between the first audio data and first acoustic characteristics data associated with the device;

determining, using the first energy data and a first portion of the first weight data, first data, the first data indicating a first direction relative to the device during a first time period;

determining, using the first energy data and a second portion of the first weight data, second data, the second data indicating a second direction relative to the device during a second time period; and determining, using the first data and the second data, that the user is in the first direction.

18. The computer-implemented method of claim 17, further comprising:

determining first coefficient data using the first audio data, the first coefficient data corresponding to the two or more microphones;

determining second weight data, the second weight data corresponding to a second cross-correlation between the first coefficient data and the first acoustic characteristics data;

determining, using the first portion of the first weight data, third data, the third data indicating that the first direction corresponds to a first local maxima of a first function;

determining, using a first portion of the second weight data, fourth data, the fourth data indicating that the second direction corresponds to a second local maxima of a second function; and determining, using the first energy data, the third data, and the fourth data, the first data.

19. The computer-implemented method of claim 18, wherein determining the first data further comprises:

determining signal quality metric data using the first energy data and second energy data, the second energy data associated with the first period of time;

determining, using the signal quality metric data, first variance data corresponding to the third data;

determining, using the signal quality metric data, second variance data corresponding to the fourth data; and determining the first data using the third data, the first variance data, the fourth data, and the second variance data.

20. The computer-implemented method of claim 17, further comprising:

determining signal quality metric data using the first energy data and second energy data, the second energy data associated with the first period of time;

determining first coefficient data using the first audio data, the first coefficient data corresponding to the two or more microphones;

determining second weight data, the second weight data corresponding to a second cross-correlation between the first coefficient data and the first acoustic characteristics data;

determining, using a first portion of the second weight data, third data, the third data including a first mean value and a first variance value;

determining a first signal quality metric value using the signal quality metric data;

determining that the first signal quality metric value is below a threshold value;

determining a second variance value by multiplying the first variance value by a first value; and determining, based on the first data, the second data, the first mean value, and the second variance value, that the user is in the first direction.

* * * * *